United States Patent [19]

Lloyd et al.

[11] 3,999,666

[45] Dec. 28, 1976

[54] VIBRATORY FEED INITIATING DEVICE FOR A MACHINE FOR FEEDING ARTICLES SHINGLE-FASHION

[75] Inventors: Allen H. Lloyd, Terrace Park, Ohio; William J. Beckman, Fort Thomas, Ky.

[73] Assignee: Multifold-International, Inc., Milford, Ohio

[22] Filed: June 17, 1975

[21] Appl. No.: 587,597

[52] U.S. Cl. ..... 214/8.5 A

[51] Int. Cl.[2] ..... B65G 59/08

[58] Field of Search ..... 214/8.5 B, 6 S, 8.5 A; 271/37, 146, 221

[56] References Cited

UNITED STATES PATENTS

| | | | |
|---|---|---|---|
| 1,957,318 | 5/1934 | Bush | 214/8.5 B |
| 3,067,885 | 12/1962 | Kohler | 214/8.5 A |

*Primary Examiner*—Stanley H. Tollberg

*Attorney, Agent, or Firm*—James W. Pearce; Roy F. Schaeperklaus

[57] ABSTRACT

A machine for feeding flat articles from an end of a stack. The stack of articles is advanced to bring an end article in the stack to a pick-off station where a belt engages the end article and articles adjacent the end article to feed the articles shingle-fashion over a discriminator. As the articles approach the end of the stack, a vibrating plate engages edges of the articles to free each article from articles on opposite sides thereof.

8 Claims, 10 Drawing Figures

VIBRATORY FEED INITIATING DEVICE FOR A MACHINE FOR FEEDING ARTICLES SHINGLE-FASHION

This invention relates to a machine for feeding flat articles such as flattened cartons from a stack of the flat articles and for feeding the articles in a shingled stream. More particularly, this invention relates to improvements in machines of the type shown in Runyan et al. application Ser. No. 437,167, filed Jan. 28, 1974, now U.S. Pat. No. 3,907,273 issued Sept. 23, 1975.

An object of this invention is to provide a machine in which objects at an end of a stack are advanced shingle-fashion from the stack and in which vibrating means is provided for separating each article from adjacent articles as the articles reach the end of the stack.

A further object of this invention is to provide a machine in which a moving belt engages uppermost articles in a stack to feed the articles and in which means is provided for starting the articles before the articles are engaged by the belt to separate each article from adjacent articles in the stack.

A further object of this invention is to provide such a machine in which a vibrator plate engages edges of the articles in the upper portion of the stack to start the articles.

A further object of this invention is to provide such a machine in which the articles are advanced over a discriminator plate by the belt, and the discriminator plate and the vibrator plate slope at substantially equal angles to the vertical and in which the vibrator plate advances the articles in the upper portion of the stack into engagement with the discriminator plate before the belt advances the articles.

Briefly, this invention provides a machine for feeding flat articles from a top or end of a stack. The articles are fed past a discriminator plate having an upper section which slopes transversely of the direction of article feeding. A belt supporting frame is pivotally mounted to swing about a pivot adjacent the discriminator plate. A belt which runs on the frame is engageable flatwise with articles on the stack to feed the articles shingle-fashion past the discriminator plate. Advance of articles is initiated by a vibrator plate which engages articles in the stack as the articles approach the end of the stack. The vibrator plate slopes transversely of the articles and engages edges of the articles opposite the discriminator plate and advances the articles toward the discriminator plate before the belt picks up the articles to advance the articles shingle-fashion past the discriminator plate.

The above and other objects and features of the invention will be apparent to those skilled in the art to which this invention pertains from the following detailed description and the drawings, in which.

In the following detailed description and the drawings, like reference characters indicate like parts.

Figure 1:
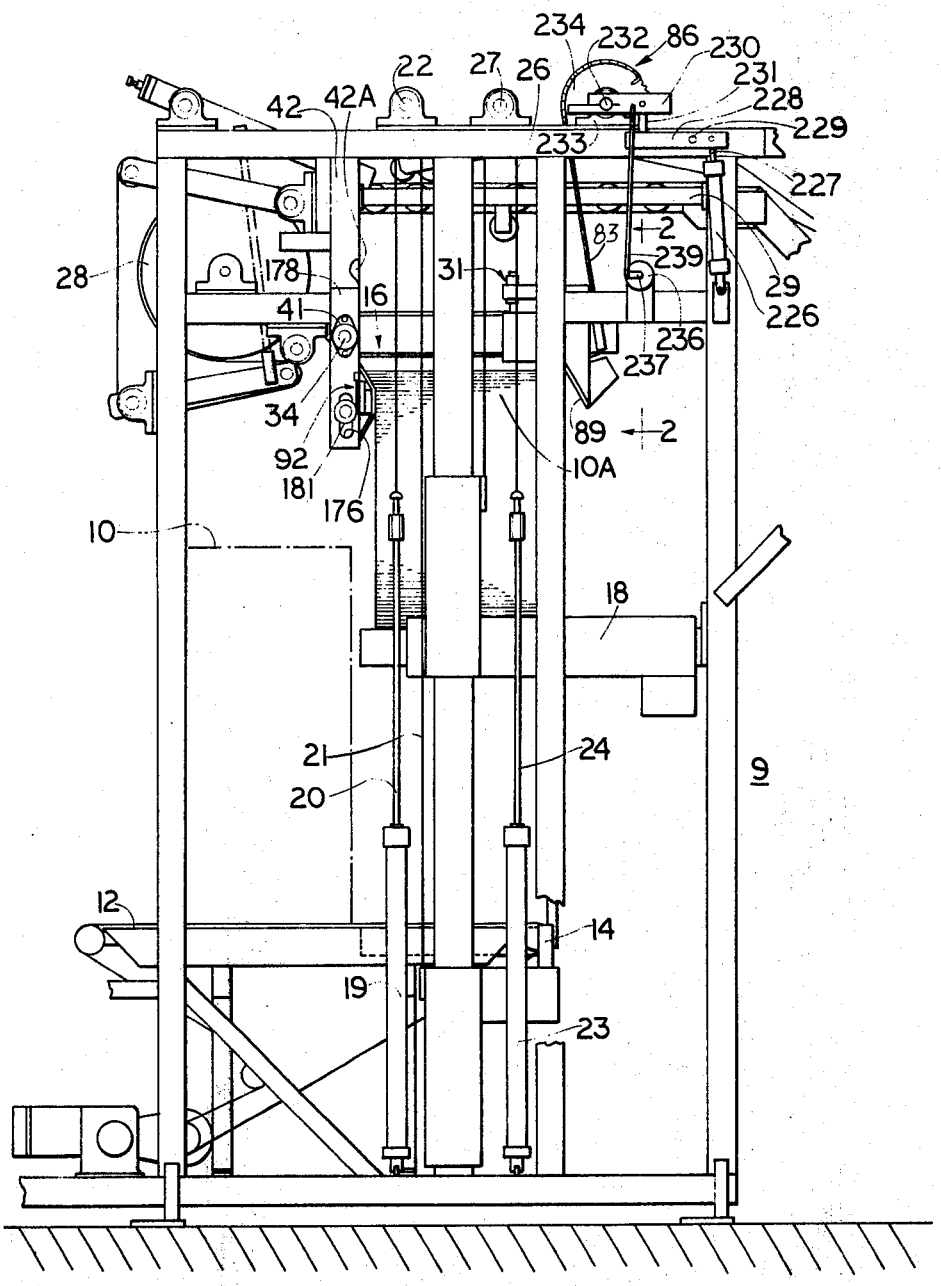
FIG. 1 is a view in side elevation of a carton feeding machine including a carton feeding assembly constructed in accordance with an embodiment of this invention, a frame thereof being partly broken away to reveal details of construction, a stack of articles entering the machine being shown in dot-dash lines.

In FIG. 1 is shown a machine 9 for feeding flat articles which is constructed in accordance with an embodiment of this invention. A stack 10 of flat articles 11 (FIG. 3), such as flattened cartons, enters the machine on belt conveyors 12 (FIG. 1). The stack is advanced by the belt conveyors 12 onto a first elevator 14 which picks up the stack and raises the stack to bring the topmost articles in the stack to a pick-off station 16. As the articles are fed from the top of the stack, the stack is raised further and the stack is transferred to a second elevator 18 which continues to raise the stack as shown at 10A. The first elevator 14 is raised by action of a cylinder 19 which draws a piston rod 20 downwardly to advance a chain 21 counterclockwise around a sprocket (not shown) mounted on a shaft 22. The second elevator 18 is raised by action of a cylinder 23 which draws a piston 24 downwardly to advance a chain 26 clockwise around a sprocket (not shown) mounted on a shaft 27 to raise the second elevator 18. From the pick-off station 16, the flat cartons are advanced shingle-fashion to a turn-over roll 28 which directs the cartons along a discharge conveyor 29. The structure described to this point can be similar in structure to like parts of the machine shown in the aforementioned Runyan et al. application Ser. No. 437,167.

Figure 2:
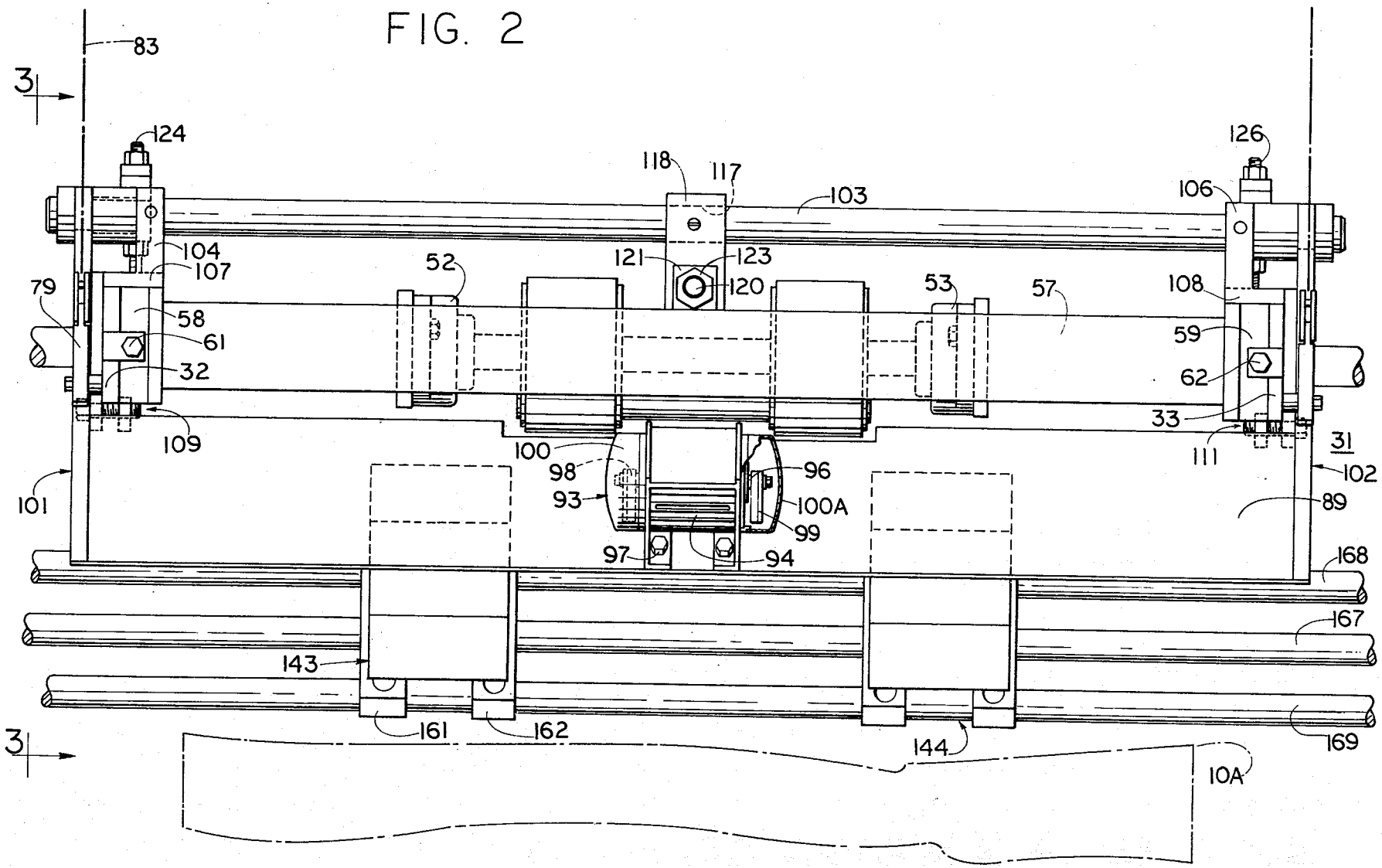
FIG. 2 is a view in end elevation on an enlarged scale of carton feeding mechanism of the machine looking in the direction of the arrows 2—2 in FIG. 1, a fragmentary portion of a stack of articles being shown in dot-dash lines in association therewith.
Figure 3:
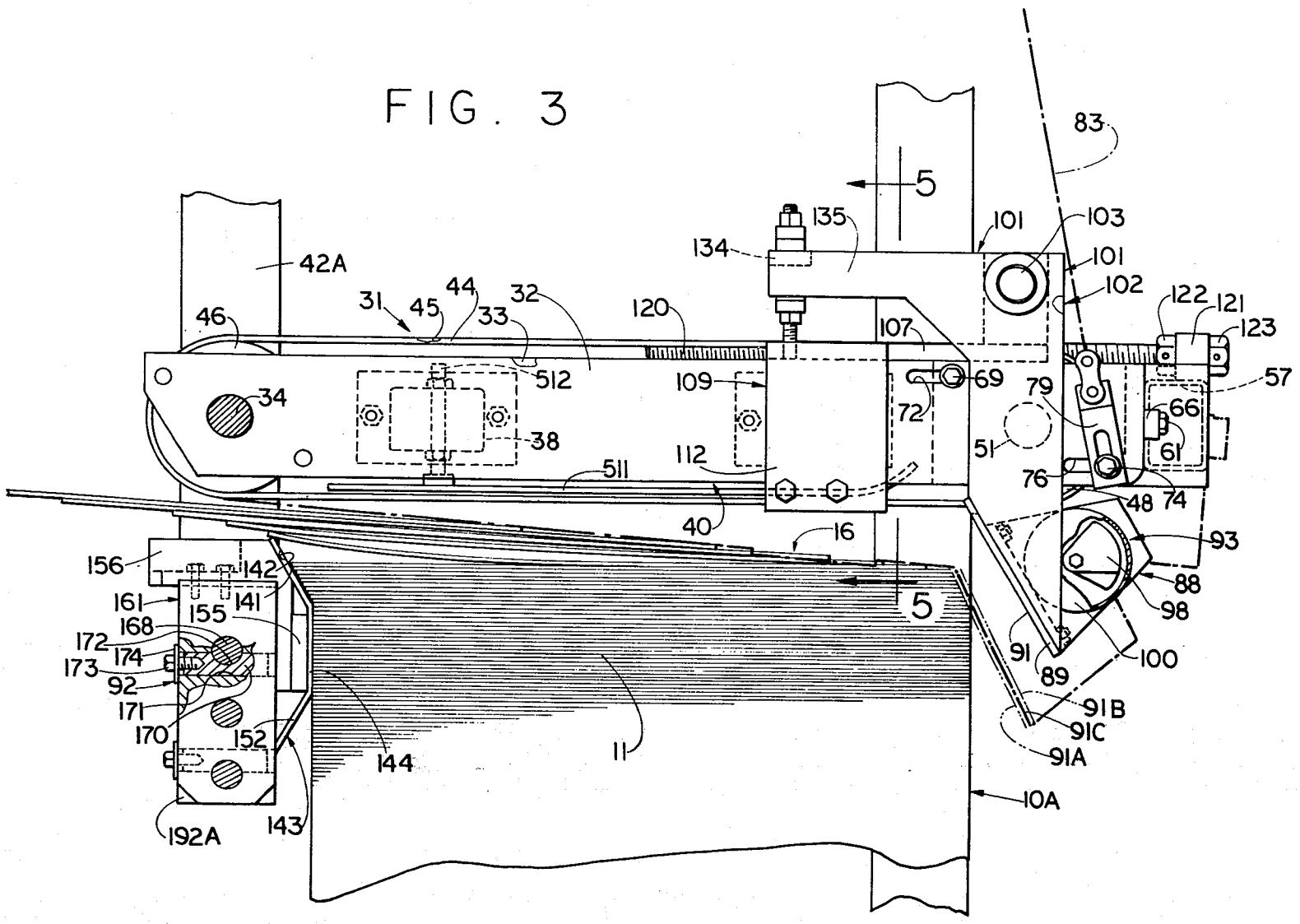
FIG. 3 is a view in section taken on the line 3—3 in FIG. 2, a belt supporting frame and associated elements being shown in full lines in a raised position and in dot-dash lines in operative position, a discriminator assembly and fragmentary portions of frame elements being shown in association therewith.
Figure 4:
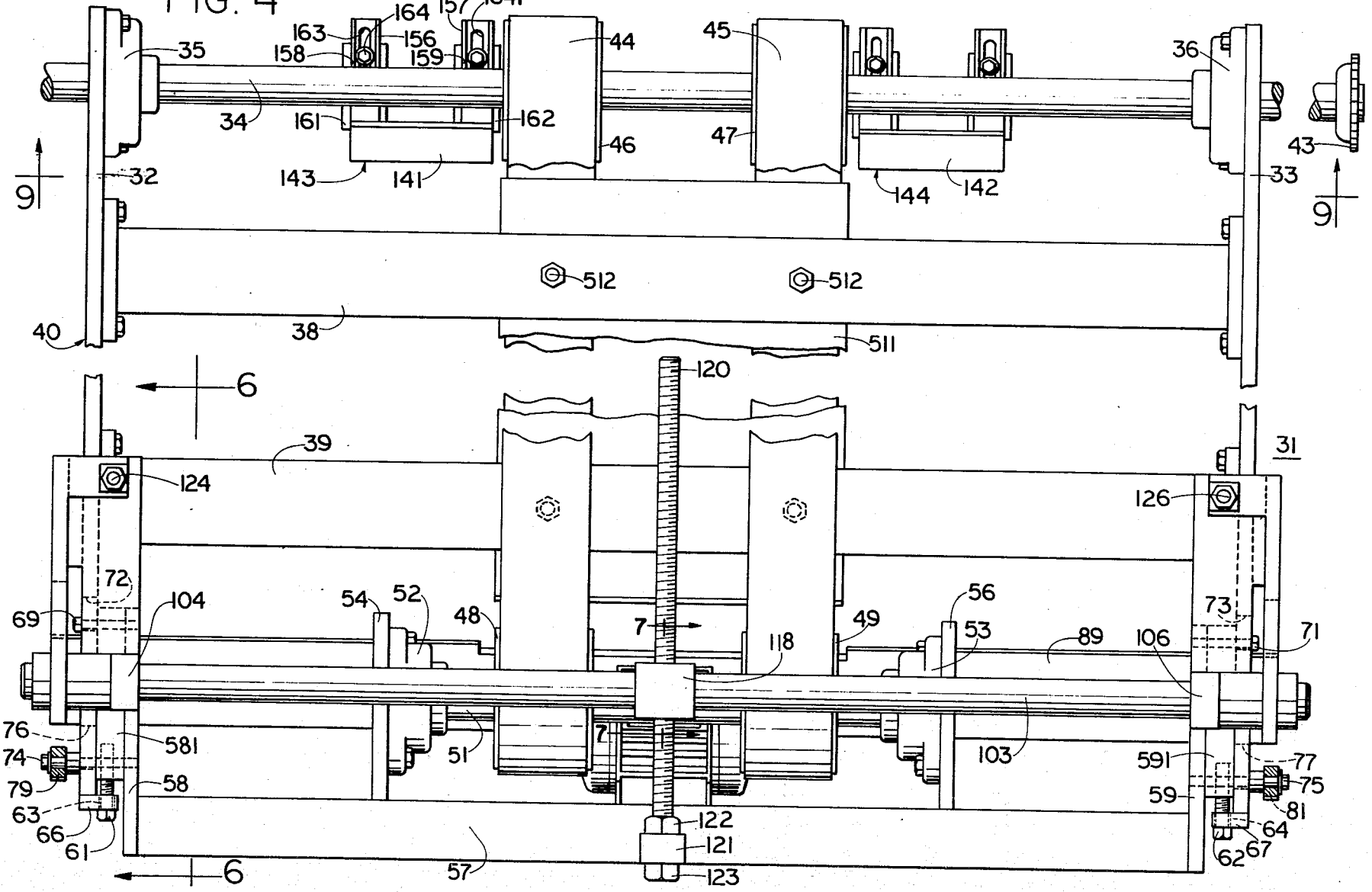
FIG. 4 is a fragmentary top plan view of the belt supporting frame and associated elements.

The cartons are advanced from the top of the stack 10A by a pick-off device 31 which is shown in FIGS. 2, 3 and 4. In these Figures, the pick-off device 31 is shown in horizontal position in full lines. In operation, the pick-off device 31 swings downwardly to substantially the position shown in dot-dash lines in FIG. 3.

The pick-off device 31 includes lengthwise frame bars 32 and 33. A transverse shaft 34 rotatably supports the frame bars 32 and 33. Bearings 35 and 36 (FIG. 4) are mounted on the frame bars 32 and 33, respectively, and rotatably receive the shaft 34. Transverse frame elements 38 and 39 span the frame bars 32 and 33 to form a rigid swinging frame 40. The transverse shaft 34 is rotatably supported in bearings 41, one of which is shown in FIG. 1. The bearings 41 are supported by upright frame elements 42 and 42A. An appropriate drive chain, not shown, drives a sprocket 43 (FIG. 4) mounted on the shaft 34 to turn the shaft 34 clockwise as shown in FIGS. 1 and 3. The bearing supports and shaft drive can be similar to like elements of the machine of the aforementioned application Ser.

No. 437,167. Pick-off belts 44 and 45 (FIG. 4) run on pulleys 46 and 47, respectively, which are mounted on the transverse shaft 34 to be driven thereby. The belts 44 and 45 also run on pulleys 48 and 49 which are mounted on a short shaft 51. Lower courses of the belts 44 and 45 are backed up by a plate 511 (FIGS. 3 and 4) supported by fasteners 512, which are adjustably mounted on the transverse frame elements 38 and 39. The short shaft 51 is journaled in bearings 52 and 53 (FIG. 4), which are mounted on plates 54 and 56, respectively, that are carried by a cross frame 57. Arms 58 and 59 are attached to ends of the cross frame 57. Jack screws 61 and 62 are threaded in blocks 581 and 591 which are mounted on the arms 58 and 59, respectively. The jack screws 61 and 62 pass through clear holes 63 and 64 in lugs 66 and 67 attached to the frame bars 32 and 33, respectively. Heads of the jack screws 61 and 62 bear on the lugs 66 and 67, respectively, and the jack screws 61 and 62 can be turned to adjust the tension in the belts 44 and 45. When the tension in the belts has been adjusted, the arms 58 and 59 are locked to the frame bars 32 and 33 by screw fasteners 69 and 71, respectively. The screw fasteners 69 and 71 are threaded in bores in the blocks 581 and 591 and extend through slots 72 and 73 in the frame bars 32 and 33, respectively. Elongated fasteners 74 and 75 are threaded in the blocks 581 and 591 and extend through slots 76 and 77 in the frame bars 32 and 33, respectively, and further serve to lock the blocks 581 and 591 and the arms 58 and 59 to the frame bars 32 and 33, respectively. The elongated fasteners 73 and 74 also serve as anchors for chain fasteners 79 and 81, respectively. Chains 83 connected to the chain fasteners 79 and 81 connect the end of the swinging frame 40 remote from the transverse shaft 34 to counterbalance and regulating mechanism 86 (FIG. 1), which controls the advance upwardly of the elevators 14 and 18 in the manner of like elements of the device of the aforementioned application Ser. No. 437,167.

Advance of the articles 11 (FIG. 3) of the stack 10A is initiated by a vibrating plate assembly 88, which includes a vibrating plate 89 having a face 91 which engages edges of articles in the stack 10A remote from a discriminator assembly 92. The plate 89 slopes upwardly and toward the discriminator 92. When the machine is in operation, the face 91 vibrates between positions indicated in double-dot-dash lines at 91A and 91B on opposite sides of a normal position indicated at 91C in dot-dash lines. The plate 89 is caused to vibrate by a vibrator motor assembly 93 which includes a motor (not shown in detail) inside a housing 94 (FIG. 2). The motor turns a shaft 96. The housing 94 is attached to the vibrating plate by appropriate fasteners 97. Eccentric weights 98 and 99 are mounted on end portions of the shaft 96 and rotate inside bells 100 and 100A. Rotation of the eccentric weights 98 and 99 causes vibration of the plate 89.

Figure 5:
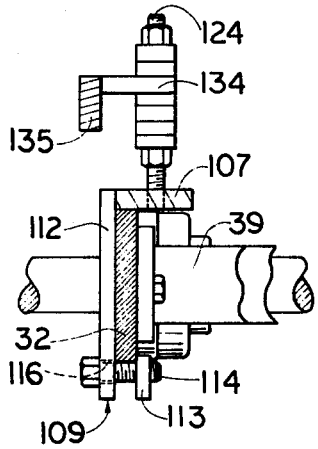
FIG. 5 is a view in section taken on the line 5—5 in FIG. 3.
Figure 6:
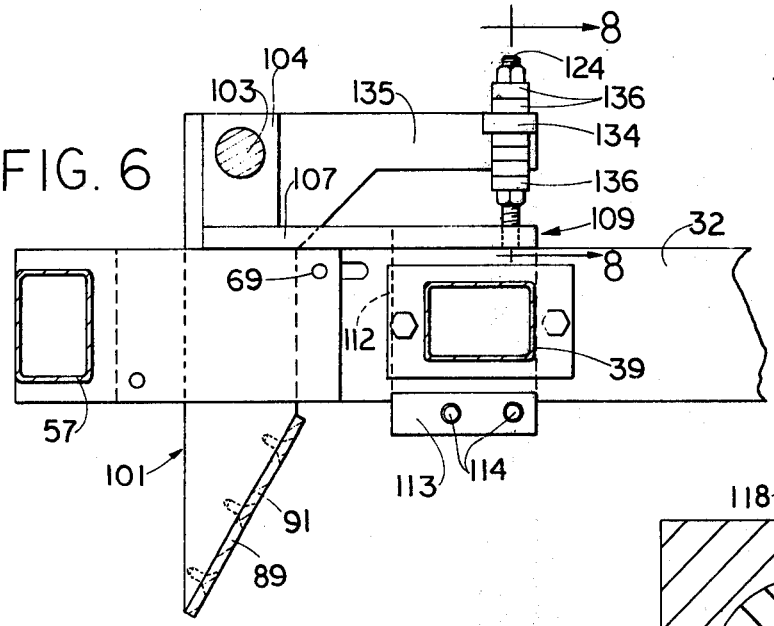
FIG. 6 is a view in section taken on the line 6—6 in FIG. 4.
Figure 7:
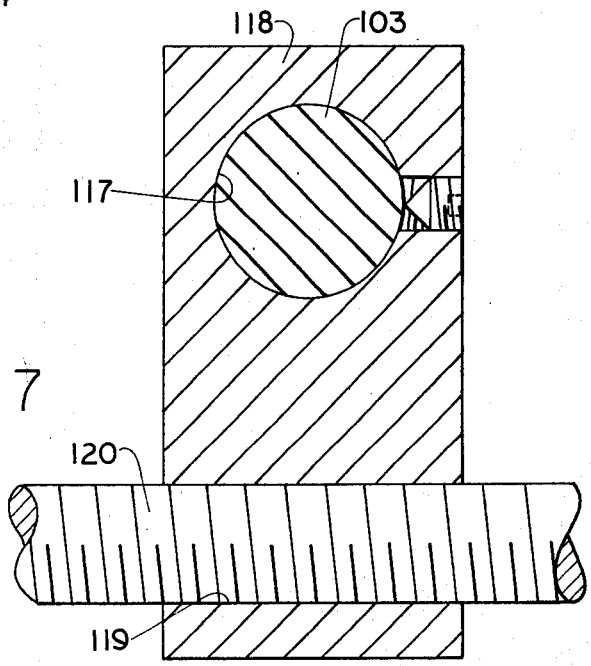
FIG. 7 is a view in section taken on an enlarged scale on the line 7—7 in FIG. 4.

The vibrating plate 89 is mounted on generally angle shaped brackets 101 (FIG. 3) and 102 (FIG. 2) which are pivotally mounted on a transverse rod 103. The rod 103 is mounted in lugs 104 and 106 which are supported on plates 107 and 108. The plates 107 and 108 rest flatwise on top of the frame bars 32 and 33 and are carried by slide assemblies 109 and 111 which are slidable lengthwise of the frame bars 32 and 33, respectively. Details of construction of the slide assembly 109 are shown in FIGS. 5 and 6, the other slide assembly 111 being of similar construction. The slide assembly 109 includes an upright plate 112 which is rigidly attached to the plate 107 and which fits flatwise against a face of the frame bar 32. A latch plate 113 is connected to the upright plate 112 be screw fasteners 114 threaded in the latch plate 113. The screw fasteners 114 extend through clear holes 116 in the upright plate 112 and substantially abut the underside of the frame bar 32. When the fasteners 114 are tightened, the assembly 109 is locked in position on the frame bar 32. The rod 103 extends through an opening 117 (FIGS. 2 and 7) in a nut block 118. The nut block 118 also has a threaded bore 119 (FIG. 7) which receives a threaded shaft 120. The shaft 120 is rotatably mounted in a block 121 (FIG. 4) attached to the cross frame 57. Collars 122 and 123 are pinned to the shaft 120 and can engage opposite faces of the block 121. The rod 103 and the assemblies 109 (FIG. 2) and 111 can be adjusted in position lengthwise of the swinging frame 40 (FIG. 3) by turning of the shaft 120 when the assemblies 109 and 111 are released.

Figure 8:
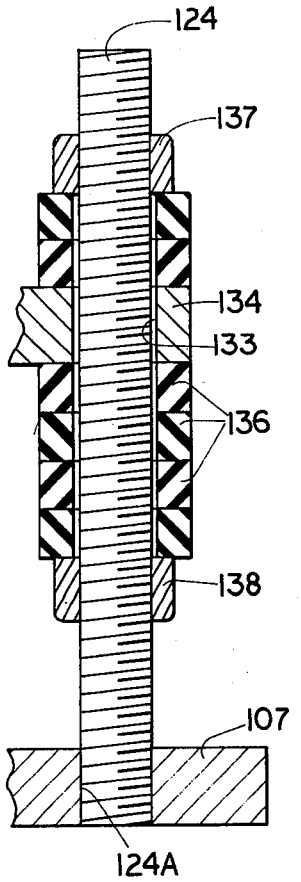
FIG. 8 is a view in section taken on an enlarged scale on the line 8—8 in FIG. 6.

The brackets 101 and 102 are stabilized by studs 124 and 126 (FIGS. 2 and 4). The studs 124 and 126 are mounted in the plates 107 and 108 respectively. The studs 124 and 126 and associated elements are similar in construction, and only the stud 124 and associated elements will be described in detail. Details of construction of the stud 124 are shown in FIGS. 5, 6, and 8. The stud 124 is mounted in an upright hole 124A in the plate 107, and can be welded in place therein. The stud 124 extends through a clear hole 133 (FIG. 8) in a plate 134 which is attached to an arm 135 (FIG. 6) of the bracket 101. Annular washers 136 of resilient rubber or other rubber-like material are mounted on the stud 124 on opposite sides of the plate 134. Nuts 137 and 138 mounted on the stud 124 hold the washers 136 in compressed condition against opposite faces of the plate 134. The washers 136 permit limited up and down movement of the plate 134 and the arm 135 (FIG. 6) with respect to the stud 124 so that the face 91 of the vibrating plate 89 can move as shown in FIG. 3 between the double-dot-dash line positions 91A and 91B to engage edges of the flat articles 11 in the stack 10A as the articles approach the top of the stack and to advance the articles to free each article from articles on opposite sides thereof. The edge of each article opposite the vibrating plate 89 can engage upper sloping sections 141 and 142 of discriminator plates 143 and 144, respectively, which are parts of the discriminator assembly 92.

The discriminator plates 143 and 144 are similar in construction, and only the discriminator plate 143 will be described in detail.

The discriminator plate 143 (FIGS. 3 and 9) includes an upright central section 149, the upper sloping section 141, and a lower sloping section 152. The upper sloping section 141 slopes upwardly from the upright section in the direction that the articles 11 are advanced by lower courses of the belts 44 and 45 at an angle of approximately 30° to the vertical. The lower sloping section 152 extends upwardly toward the upright section 149 and in a direction opposed to that at which the articles 11 are advanced by the lower courses of the belts 44 and 45 at an angle of approximately 30° to the vertical. As the stack 10A is moved upwardly, if any of the articles in the stack are misplaced to the left as shown in FIG. 3, that article engages the lower sloping section 152 and is advanced to the right into alignment with the upright section 149. As the articles in the stack are advanced further upwardly, the articles come into engagement with the vibrating plate 91 which engages right hand edges of the articles to advance each article to the left with respect to the next lower article to cause separation of the articles from each other. Then, as the lower courses of the belts 44 and 45 pick up the articles, the articles are advanced shingle-fashion over the upper edge of the upper sections 141 and 142 of the discriminator plates 143 and 144.

Figure 9:
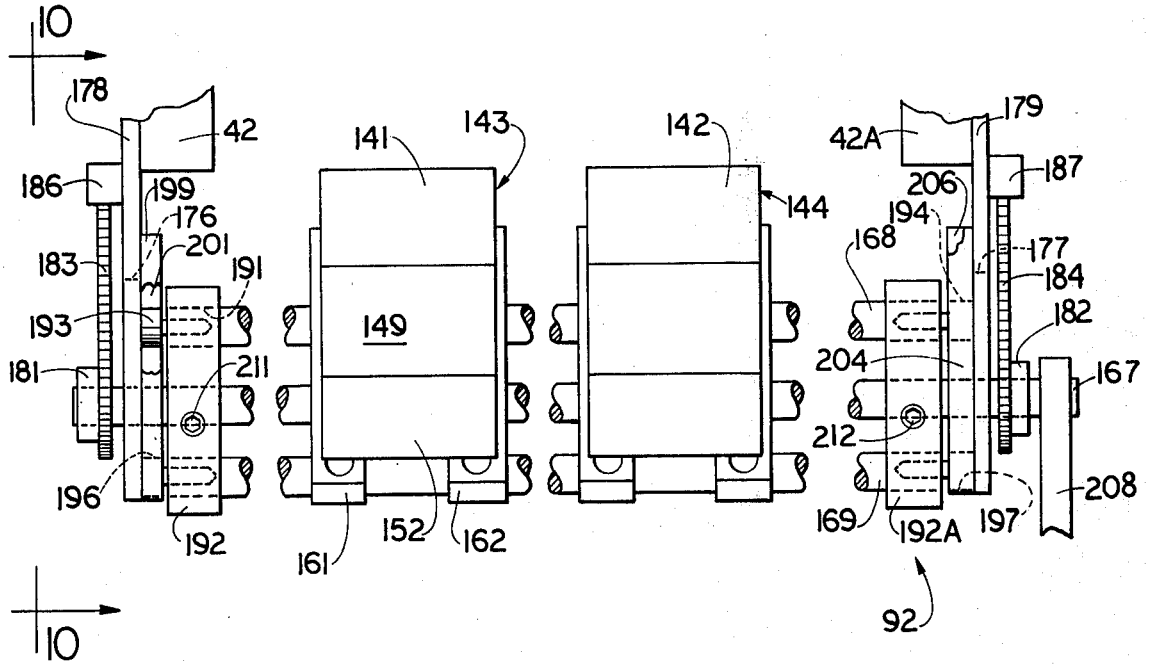
FIG. 9 is a fragmentary view looking in the direction of the arrows 9—9 in FIG. 4.

The discriminator plate 143 is mounted on a block 155 which is carried by angle shaped brackets 156 and 157 (FIG. 4). Upper arms of the brackets 156 and 157 are slidably received in slots 158 and 159 in mounting blocks 161 and 162, respectively. The discriminator plate 143 can be adjusted to the right or left as shown in FIG. 3 with respect to the mounting blocks 161 and 162 (FIG. 4) together with the brackets 156 and 157. Fasteners 164 extend through slots 163 and 1641 in the mounting blocks 161 and 162, respectively, and lock the brackets 156 and 157 in position on the mounting blocks 161 and 162. The mounting blocks 161 and 162 are slidably mounted on a transverse adjusting rod 167 and transverse stabilizing rods 168 and 169. The mounting blocks are locked in position on the stabilizing rods 168 and 169 by lock bars, one of which is indicated at 170 (FIG. 3). Each lock bar 170 is slidably mounted in a transverse bore 171 in its associated mounting block 161. An arcuate slot 172 in the lock bar 170 receives its associated stabilizing rod 168. A fastener 173 bears on a washer 174 which engages a face of the mounting block 161. Tightening of the fastener 173 causes the lock bar to grip the stabilizing rod 168. The discriminator assembly 92 is mounted for up and down movement. Ends of the adjusting rod 167 extend through upright slots 176 (FIG. 1) and 177 (FIG. 9) in upright frame plates 178 and 179 which are mounted on the frames 42 and 42A, respectively, as shown in FIG. 9. Sprockets 181 and 182 carried by the adjusting rod 167 are supported by chains 183 and 184, respectively. Upper ends of the chains 183 and 184 are supported by brackets 186 and 187 attached to the frame bars 178 and 179, respectively.

Figure 10:
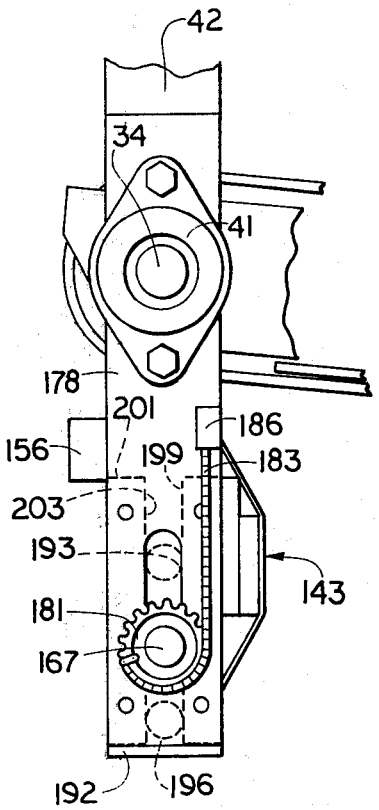
FIG. 10 is a fragmentary view in side elevation looking in the direction of the arrows 10—10 in FIG. 9.

Ends of the stabilizing rods 168 and 169 are received in transverse bores 191 in blocks 192 and 192A. Guide rollers 193 and 194 are carried at opposite ends of the stabilizing rod 168, and guide rollers 196 and 197 are carried by opposite ends of the stabilizing rod 169. As shown in FIGS. 9 and 10, upright plates 199 and 201 are attached to the frame plate 178 and define an upright slot 203 in which the guide rollers 193 and 196 run. Similar upright plates 204 and 206 (FIG. 9) are attached to the frame plate 179 to define an upright slot in which the guide rollers 194 and 197 move. A handle 208 (FIG. 9), only a part of which is shown, is attached to an end portion of the adjusting rod 167. The handle 208 can be turned to turn the adjusting rod 167 and the sprockets 181 and 182 to move the discriminator assembly 92 up and down. Lock bars (not shown in detail) actuated by fasteners 211 and 212 permit locking of the adjusting rod 167 in adjusted position. The lock bars actuated by the fasteners 211 and 212 can be similar in construction and operation to the lock bars 170 already described with relation to FIG. 3.

When the machine is in operation, the stack 10 (FIG. 1) is advanced by the belt conveyors 12 onto the first elevator 14. The first elevator 14 picks up the stack and raises the stack until the topmost articles of the stack are at the pick-off station 16. The first elevator 14 raises the stack until the top of the stack engages the lower courses of the belts 44 and 45 (FIG. 3) and raises the end of the swinging frame 40 remote from the shaft 34 to a selected height, such as that shown in dot-dash lines in FIG. 3. The chains 83 connect that end of the swinging frame 40 to the counterbalance and regulating mechanism 86 (FIG. 1). The mechanism 86 can be similar to like elements of the device of the aforementioned copending application Ser. No. 437,167 and includes a cylinder 226 which serves to counterbalance the major portion of the weight of the swinging frame 40 (FIG. 3). The counterbalance cylinder 226 (FIG. 1) pushes its piston rod 227 upwardly to swing a lever 228 about its pivot 229. The lever 228 is linked to a crank 230 by a link 231. The crank 230 is mounted on a transverse shaft 232, which is rotatably mounted in bearings 233, one of which is shown in FIG. 1. Upper end portions of the chains 83 extend around and are attached to sprockets 234 (only one of which is shown) mounted on the shaft 232. A predetermined pressure is maintained in the cylinder 226 to counterbalance the swinging frame 40. A control valve 236 (details of which are not shown) is actuated by a crank 237. The crank 237 is linked to the crank 230 by a link 239 so that, as the swinging frame 40 (FIG. 3) swings up and down, the crank 237 (FIG. 1) is swung counterclockwise and clockwise. The control valve 236 is arranged to direct fluid under pressure to the cylinder 19 when the stack is on the first elevator 14 as required to cause controlled raising of the stack when the swinging frame swings downwardly as articles are removed from the top of the stack. When the first elevator 14 has raised the stack a predetermined amount and a portion of the stack has been discharged the second elevator 18 takes the stack from the first elevator 14 and the control valve 236 directs fluid under pressure to the cylinder 23 to cause further controlled advance upwardly of the stack.

As the articles in the stack approach the top of the stack, the vibrating plate 89 (FIG. 3) engages edges of the articles opposite the discriminator assembly 92 to advance each article incrementally with respect to the articles above and below it in the stack. Articles in a stack often tend to stick or adhere to adjacent articles because of printing and finishes on faces thereof or for other reasons. The vibrator plate 89 advances each article crosswise of adjacent articles a sufficient amount to cause release of each article from adjacent articles before the belts 44 and 45 advance the articles. Then, as the articles come to the top of the stack, the lower courses of the belts 44 and 45 pick up the articles and feed the articles shingle-fashion over upper edges of the discriminator plates 143 (FIG. 3) and 144 (FIG. 2) to be discharged around the turn-over roll 28 (FIG. 1) and along the discharge conveyor 29.

The invention has been described particularly with reference to a machine in which articles are fed from an upper end of an upright stack, but the stack can be otherwise positioned and the machine illustrated in the drawings and described above is subject to structural modification without departing from the spirit and scope of the appended claims.

Having described our invention, what we claim as new and desire to secure by letters patent is:

1. A machine for withdrawing articles from the top of an upright stack of flat articles and feeding the articles therefrom shingle-fashion which comprises means for raising the stack of articles to bring the topmost article in the stack to a pick-off station, a pick-off device at the pick-off station which includes a swinging frame, a pick-off belt running on the swinging frame, the belt having a lower course arranged for flatwise engagement with the topmost article, means for pivotally mounting the swinging frame adjacent a discharge end of the pick-off device, a discriminator at the pick-off station engageable with the articles below the topmost articles in the stack, a vibrating plate engageable with edges of the articles in the stack as the articles approach the pick-off station, means for causing the vibrating plate to vibrate transversely of the articles to advance each article with respect to adjacent articles in the stack to cause release of each article from adjacent articles, means for driving the pick-off belt to advance the topmost articles over the discriminator, and conveyor means receiving the articles as they pass over the discriminator, the pick-off belt engaging articles underlying the topmost article as the topmost article is being advanced by the pick-off belt to advance the articles in shingle-fashion.

2. A machine as in claim 1 wherein the vibrating plate is mounted on bracket means, the bracket means is pivotally mounted on the swinging frame, and means resiliently connects the bracket means to the swinging frame remote from the pivot of the bracket means to permit limited vibratory movement of the vibrating plate.

3. A machine as in claim 2 wherein the means for causing the vibrating plate to vibrate is a vibrator attached to the vibrating plate.

4. A machine as in claim 3 wherein the vibrator includes a housing attached to the vibrating plate, a motor having a motor shaft parallel to the vibrating plate and rotatably mounted inside the housing, and an eccentric weight mounted on the shaft to cause vibration of the housing and of the vibrating plate when the motor rotates the motor shaft.

5. A machine as in claim 1 wherein the vibrating plate engages edges of the articles in the stack opposite to the discriminator and advances the articles toward the discriminator.

6. A machine as in claim 5 wherein the vibrating plate has a sloping article engaging face which extends upwardly and toward the discriminator at an angle of approximately 25° to the vertical.

7. A machine for withdrawing articles from an end of a stack of flat articles and feeding the articles therefrom shingle-fashion which comprises means for advancing the stack of articles to bring the endmost article in the stack to a pick-off station, a pick-off device at the pick-off station which includes a swinging frame, a pick-off belt running on the swinging frame, the belt having a course arranged for flatwise engagement with the endmost article, means for pivotally mounting the swinging frame adjacent a discharge end of the pick-off device, a discriminator at the pick-off station engageable with articles in the stack other than the endmost articles, a vibrating plate engageable with edges of the articles in the stack as the articles approach the pick-off station, means for causing the vibrating plate to vibrate transversely of the articles to advance each article with respect to adjacent articles in the stack to cause release of each article from adjacent articles, means for driving the pick-off belt to advance the endmost articles past the discriminator shingle-fashion, and conveyor means receiving the articles as they pass the discriminator.

8. A machine for withdrawing articles from an end of a stack of flat articles and feeding the articles therefrom shingle-fashion which comprises means for advancing the stack of articles to bring the endmost article in the stack to a pick-off station, a pick-off device at the pick-off station for drawing articles from the stack shingle-fashion, said pick-off device including a swinging frame, a pick-off belt running on the swinging frame, the belt having a course arranged for flatwise engagement with the endmost article, means for pivotally mounting the swinging frame adjacent a discharge end of the pick-off device, a discriminator at the pick-off station engageable with articles in the stack other than the endmost articles, a vibrating plate engageable with edges of the articles in the stack as the articles approach the pick-off station, means for causing the vibrating plate to vibrate transversely of the articles to advance each article with respect to adjacent articles in the stack to cause release of each article from adjacent articles, means for driving the pick-off device to advance the endmost articles past the discriminator shingle-fashion, and means receiving the articles as they pass the discriminator, the pick-off belt engaging articles adjacent the endmost article as the endmost article is being advanced by the pick-off belt to advance the articles shingle-fashion.

* * * * *